United States Patent [19]

Hradcovsky

[11] 4,082,626

[45] Apr. 4, 1978

[54] PROCESS FOR FORMING A SILICATE COATING ON METAL

[76] Inventor: Rudolf Hradcovsky, 27 W. Beach St., Long Beach, Long Island, N.Y. 11561

[21] Appl. No.: 751,252

[22] Filed: Dec. 17, 1976

[51] Int. Cl.[2] ..... C25D 11/02; C25D 11/06; C25D 11/34

[52] U.S. Cl. ..... 204/56 R; 204/58

[58] Field of Search ..... 204/56 R, 58

[56] References Cited

U.S. PATENT DOCUMENTS

| | | | |
|---|---|---|---|
| 3,832,293 | 8/1974 | Hradcovsky et al. | 204/56 R |
| 3,956,080 | 5/1976 | Hradcovsky et al. | 204/56 R |

*Primary Examiner*—R. L. Andrews

[57] ABSTRACT

A relatively low voltage process for electrolytically coating a rectifier metal with a hard, glassy, corrosion-resistant silicate coating. The rectifier metal is immersed in an aqueous solution of pure potassium silicate (or a mixture of potassium silicate and a peroxide, e.g., sodium peroxide) and a voltage potential is applied between said metal and a cathode which is also immersed in said solution until a visible spark is discharged at the surface of the rectifier metal. The voltage potential is then increased to about 300 volts and maintained at that level until the desired thickness of the coating is deposited.

28 Claims, 3 Drawing Figures

PROCESS FOR FORMING A SILICATE COATING ON METAL

BACKGROUND OF THE INVENTION

1. Field of the Invention

This invention relates to a method for forming glassy coatings on metals. More particularly, the present invention is concerned with a method for forming a hard silicate coating on metals. Still more particularly, this invention is concerned with an electrolytic method for forming an impervious corrosion-resistant silicate coating on metals, especially aluminum.

2. Description of the Prior Art

Electrolytic procedures for depositing silicate coatings no metals are known. For example, Czechoslovakian Pat. No. 104,927 issued Sept. 15, 1962, to Hradcovsky and Belohradsky discloses an electrolytic method for depositing a silicate coating on aluminum employing as the electrolyte a weekly alkaline aqueous bath composed of 10 to 15% sodium or potassium silicate and a hardener such as 3% ammonium molybdate. When the anode is aluminum and the cathode is iron or nickel, and an increasing voltage is impressed across the electrodes, a silicate coating begins to form at a voltage of about 300 volts. The coating formed by the method described in said Czechoslovakian patent was intended to have a weak break-down voltage, and is a highly porous coating.

More recently, Hradcovsky and Kozak in U.S. Pat. No. 3,834,999, issued Sept. 10, 1974, disclosed forming a non-porous glassy protective coating on various rectifier metals, including aluminum, by an electrolytic process employing as the electrolyte a bath containing an alkali metal silicate and an alkali metal hydroxide. The metal is made progressively more anodic until at 250 volts a discharge occurs and deposition of the coating begins. Voltages of at least about 400 volts are required to obtain a satisfactory coating and coatings of about 1mm thickness may be readily prepared by this method. The silicate electrolytes disclosed are relatively dilute, and are rendered alkaline with an alkali metal hydroxide, with an alkali concentration of about 15% being desired to achieve the hardest coating. The intent of this process was to provide a glassy, adherent, corrosion-resistant protective layer on the metal, in contrast to the porous layer of the Czechoslovakian patent.

Still later, it was discovered that rectifier metals may be provided with durable silicate protective coatings by electrolysis in an electrolyte comprising a strongly alkaline bath containing an alkali metal silicate, an alkali metal hydroxide and an oxyacid catalyst. In this process, a voltage of at least 220 volts is required to deposit a coating. When the voltage exceeds about 220 volts, sparking occurs, causing deposition of the desired coating. However, depending upon the bath composition, voltages of up to 1,500 volts may be required to deposit a satisfactory coating. As in the prior process, the silicate content of the electrolyte bath is relatively low. In particular, the silicate concentration is 2.5 to 200 grams per liter, and preferably 10 to 50 grams per liter, especially 15 to 25 grams per liter. See U.S. Pat. No. 3,832,293.

Although the methods of the above-described United States patents impart glassy, protective silicate coatings which are superior to the porous coatings of the Czechoslovakian patent, they require substantial voltages and involve a relatively high consumption of electricity. Furthermore, substantial periods of time on the order of several minutes or more are required to build up coatings of the desired thickness following the teachings of these patents. In addition, certain of the electrolyte baths disclosed by these references, particularly baths containing sodium silicate, are unstable with resulting precipitation and change in electrolyte content so that the bath may not be reused over any substantial period of time.

SUMMARY OF THE INVENTION

It is an object of this invention to provide an improved electrolyte process for imparting silicate coatings to metals, particularly aluminum.

Another object of this invention is to provide an electrolyte process for forming silicate coatings on rectifier metals at lower voltages than heretofore generally employed.

Still another object of this invention is to form a silicate protective coating on rectifier metals with reduced consumption of electricity.

A still further object of the invention is to provide such coatings in less time than heretofore required.

It is also an object of this invention to provide coatings which are uniformly applied on the surface of the rectifier metal.

Yet another object of this invention is to provide a coating process utilized an electrolyte bath which is stable over a long period of time.

These, and other objects of this invention, which will be evident from the ensuing detailed description, are obtained by coating the metal specimen as the anode through an efficient, relatively low voltage electrolytic process, employed as the electrolyte an aqueous bath consisting of relatively pure potassium silicate at concentrations higher than those previously employed. The rectifier metal may be additionally treated either before or after coating, or both, and an additive may be included in the electrolyte coating bath in order to vary the color of the coating deposited on the rectifier metal.

In another embodiment of this invention a peroxide, such as, e.g., sodium peroxide may be added to the potassium silicate bath solution to obtain even harder, smoother, more highly dielectric and more anti-corrosive silicate coating.

Figure 1:
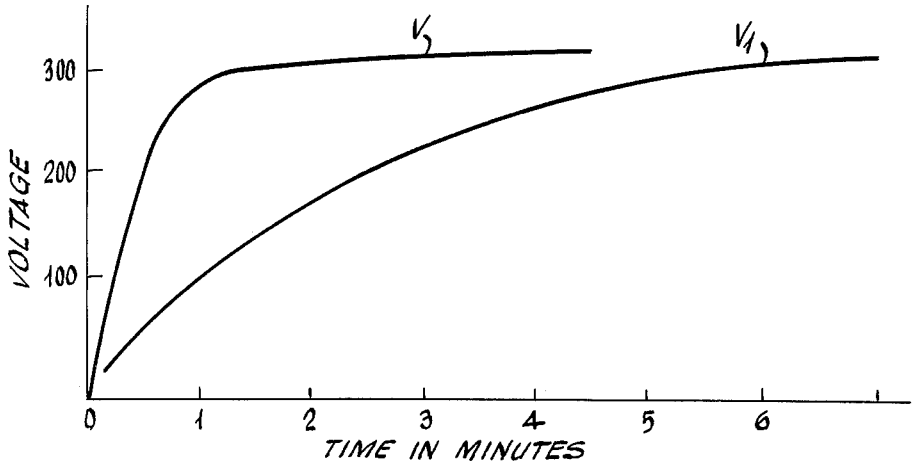
FIG. 1 is a graph of voltage as a function of time required for electrolytic coating of an aluminum alloy sample in potassium silicate baths of two different concentrations.

These figures will be further described in the following detailed description of the invention.

DETAILED DESCRIPTION OF THE INVENTION

In accordance with one embodiment of this invention, the rectifier metal, for example, aluminum, is immersed in a relatively concentrated potassium silicate aqueous solution, as discussed hereinbelow, and a second electrolytically insoluble metal, such as iron or nickel, also is immersed in the bath. An electrical potential is applied across the two metals so that the rectifier metal serves as the anode and the second metal serves as the cathode. The metal is made progressively more anodic until sparking is observed, at which time the desired coating begins to form. When the concentrated silicate baths as described herein are employed, sparking begins at about 150 volts. The potential is increased to about 300 volts and maintained at about 300 volts for the period of time necessary to complete the deposition of the protective coating. From about 1 to about 5 minutes are usually required to produce a coating of approximately 0.001 inch thickness.

The process of this invention can be used to coat a variety of metals which, under the electrolytic conditions used herein, exhibit rectifying qualities. The term rectifier metals, therefore, denotes such metals which include aluminum, tantalum, niobium and their alloys together with alloys of aluminum with copper and zinc. In case of alloys, best results are obtained when the relative composition of the alloy is such that the non-aluminum component thereof does not exceed about 15 weight percent. The process of this invention, however, is best suited for aluminum metal.

The essential element of the process of this invention is the use, as the electrolyte, of a bath consisting essentially of a concentrated aqueous solution of potassium silicate. Such an electrolyte is distinguished from those of the above-mentioned patents by the absence of cations other than potassium and the absence of anions other than silicate, except as may form on dissolution of potassium silicate in water.

The electrolyte employed in accordance with this invention may be formed from commercially available potassium silicate of technical purity, e.g., 99 percent purity.

The potassium silicate electrolyte solution can be used in a concentration ranging from about 5° to about 30° Baume, although optimum results are achieved when this concentration is from about 5° to about 20° Baume. Such an electrolyte is much more stable than electrolytes based upon sodium silicate, which form a visible precipitate in only a few weeks. The electrolytes of this invention are stable for periods of one year or more.

More significantly, the electrolyte of this invention is more efficient than prior electrolytes in its electrolytic oxidizing ability and its ability to form a rectifying coating on the metal serving as the anode. Moreover, unlike other electrolytes, the potential required to form the desired protective coating is relatively constant, regardless of the metal to be coated. For example, in prior processes, the voltage could vary widely among aluminum and its alloys with coper or zinc. Such variations are not observed with the electrolyte of this invention.

The high concentration of potassium silicate which characterizes the present process accelerates the rate of coating (thus decreasing the coating time), contributes to the uniform application of the coating, and accounts for the fact that the resulting coating meets the industry's anti-corrosive standards.

As hereinbefore described the rectifier metal is immersed in the electrolytic bath, and a potential difference is applied across the rectifier metal, which serves as the anode, and an electrolytically insoluble second metal, which serves as the cathode, and which is also immersed in the bath. The container or tank for the bath may conveniently be composed of an electrolytically insoluble metal and may itself constitute the cathode and direct current is usually applied across the two terminals.

Varying current densities may be employed, with the coating being deposited faster at higher current ensities. The optimum current density for the process of this invention is about 6–10 amperes/sq.ft. However, a current density such as 1 ampere/sq.ft. would be employed to deposit a silicate coating more slowly. The thickness of the coating depends on the voltage used, the deposition time, and the concentration of the electrolyte. For most alloys, the first oxidizing stage occurs within 3–10 seconds of the application of the potential difference, and actual growth of the silicate coating of the desired thickness of about 0.001 inch occurs in the period of about 'to about 5 minutes depending on the concentration of the electrolyte.

The temperature of the electrolyte bath may vary within the range of about 20° C to about 70° C during the coating process although a temperature range of about 25° C to about 55° C is preferred. Where the metal to be coated is large and substantial amounts of heat are generated during the coating process, it may be desirable to use auxiliary cooling means to remove the heat from the electrolytic bath.

The coatings obtained by the practice of the present invention are smooth, hard and snow-white. The chemical properties of the potassium silicate applied on the surface of aluminum, its alloys, or other metals are similar to the chemical properties of ceramics. They are insoluble in hot, concentrated acids, and they are resistant to most chemical reagents except hydrofluoric acid.

The following examples illustrate the use of potassium silicate solution of various concentrations in the electrolytic coating of aluminum in accordance with this invention. These examples, which are illustrative of the method described herein are not to be construed as limiting the scope of the invention either with respect to the metals which can be used or the conditions which can be applied during the electrolytic procedure.

EXAMPLE I

An electrolytic bath was prepared consisting of 100 grams of water and 500 grams of a 30°Be. solution of potassium silicate. A 50 × 50 × 1mm. aluminum sheet metal (AA 100.1 aluminum alloy) was placed in the bath at ambient temperature (25° C.). The aluminum sheet served as the anode and an iron sheet was immersed into the bath which served as the cathode. The initial current was 2 amperes and the electrolysis period was 3 minutes.

A pure, milk-white silicate coating was formed on the aluminum. The coating which was 0.001 inch thick met the U.S. standard. The coated sample was dried by a flow of warm air and was found to be corrosion resistant.

EXAMPLE II

The procedure of Example 1 was repeated except that the electrolyte bath consisted of 1,000 g of water and 550 g of a 30° Be. solution of $K_2SiO_3$.

EXAMPLE III

The procedure of Example I was repeated except that the electrolyte bath consisted of 1,000 g of water and 600 g of a 30° Be. of $K_2SiO_3$.

EXAMPLE IV

The procedure of Example I was repeated except that the electrolyte bath consisted of 1,000 g of water and 650 g of a 30° Be. of $K_2SiO_3$.

EXAMPLE V

The procedure of Example I was repeated except that the electrolyte bath consisted of 1,000 g of water and 400 g of a 30° Be. solution of $K_2SiO_3$.

EXAMPLE VI

The procedure of Example I was repeated except that the electrolyte bath consisted of 1,000 g of water and 200 g of a 30° Be. solution of $K_2SiO_3$.

Figure 2:
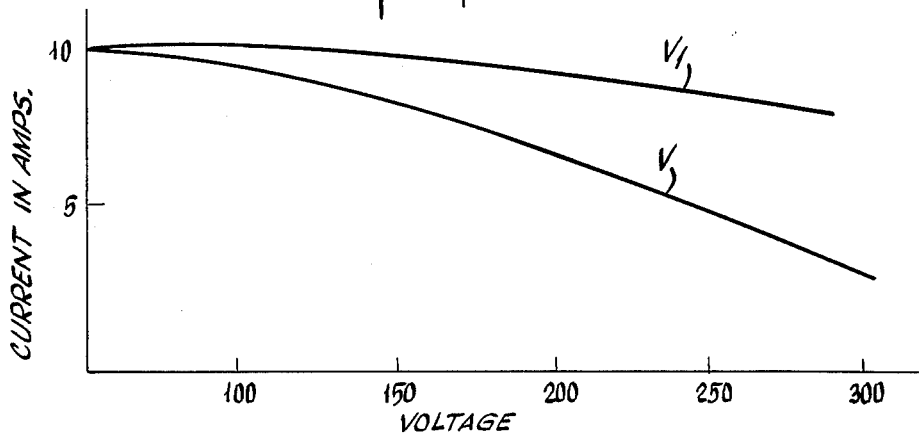
FIG. 2 shows the relationship between the current and voltage required for electrolytic coating of aluminum in the potassium silicate baths referred to in FIG. 1.

Figure I shows the voltage as a function of time for obtaining 0.001 inch coatings in accordance with Examples V and VI. The final working voltage is about 300 volts and the desired coating is obtained in about 5 minutes or less. It will be noted from this figure that the desired coating is obtained more rapidly in Example V due to higher concentration of the electrolyte. Also, as it is evident from FIG. 2, the current (and therefore the current density) required in Example V is significantly lower than Example VI, once again indicating that higher electrolyte concentrations are more advantageous.

As an alternative to producing the white coating described above, the process of the present invention may be modified so that non-white coatings, especially gray and black coatings, can be produced. Thus, an electrolyte bath is prepared containing potassium silicate at a concentration of about 1 to about 10° Be., preferably about 5° Be. One hundred parts of this bath is then mixed with about 30 parts of a saturated solution of potassium vanadate and the metal to be coated is then immersed in this solution and electrolyzed in accordance with the method of this invention as hereinbefore described. A white precipitate formed at about 150 to about 275 volts which then changed in color to gray-black at about 300 volts and finally to a black precipitate at this voltage potential.

Both potassium vanadate and lithium vanadate may be used to produce a gray or black coating and their concentrations may generally vary from about 1 to about 30 grams per liter depending on the ultimate desired shade or color of the coating.

Sometimes it may be desirable to pretreat the metal in order to clean the surface to be coated. For example, the metal to be coated may be anodized for a short period of time, on the order of 10 seconds, and then subjected to the coating process of the present invention.

The metal articles that have been coated according to the above-described process may be finished in one of several ways. Although the potassium silicate coatings meet all anti-corrosive standards without any further modifications, the coated metal articles may be treated in such a manner as to increase the resistance of the coating to certain chemicals. Two such finishing processes are disclosed hereinbelow.

As a first alternative, the silicate-coated metal article is soaked in an aqueous solution of potassium silicate and then dried in an atmosphere containing carbon dioxide, e.g., air. The concentration of potassium silicate for this purpose may vary from about 12° to about 25° Be. It is believed that a thin coating of the silicate from the soaking solution reacts with the coating applied electrolytically and with carbon dioxide adsorbed from the atmosphere to improve the anti-corrosive properties of the coating. The finished coating is inert to concentrated alkaline hydroxides and to chlorides, such as tin chloride.

As a second alternative for finishing the silicate-coated metal article, the coated article is immersed in a solution of an epoxy glue in a suitable organic solvent such as e.g., acetone or carbon tetrachloride. This finishing process can improve the anti-corrosive properties of the silicate coatings against attack at higher temperatures (50°–70° C) by strong alkaline hydroxides, chlorides, sulfates and other chemicals.

In another embodiment of this invention, still more improved coatings may be deposited on the metals by the addition of a suitable peroxide to the potassium silicate solution. Such peroxides include sodium peroxide, potassium peroxide, lithium peroxide, cessium peroxide and strontium peroxide, or mixtures thereof. The concentration of these peroxides may vary from about 1 to about 25 gms per liter and the concentration of the potassium silicate employed is essentially the same as hereinbefore described.

When using a peroxide solution in the bath, other silicates such as, e.g., lithium silicate and sodium silicate may also be added to the bath although the use of potassium silicate and peroxide constitutes a preferred practice under this embodiment of the invention. The peroxide concentration may generally vary from about 1 to about 30 grams per liter.

The following examples illustrate the use of peroxides in this embodiment of the invention. Once again, these examples are intended to be illustrative rather than limiting the scope of the invention.

EXAMPLE VIII

The procedure followed in this example was the same as in Example I except that the electrolytic bath solution consisted of 300 grams of 30° Be. potassium silicate, 30 grams of sodium peroxide and 1,000 grams of water.

EXAMPLES IX - XVI

The procedures in these examples were also the same as in Example I except for varying the bath composition. The silicates used in these examples were all 30° Be.

| Example | Composition electrolytic bath |
|---|---|
| IX | 150 grams potassium silicate<br>20 grams potassium peroxide<br>1000 grams water |
| X | 150 grams potassium silicate<br>150 grams lithium silicate<br>1000 grams water |
| XI | 150 grams potassium silicate<br>150 grams lithium silicate<br>50 grams lithium peroxide<br>1000 grams water |
| XII | 400 grams potassium silicate<br>50 grams sodium silicate<br>20 grams sodium peroxide<br>1000 grams water |
| XIII | 300 grams lithium silicate<br>150 grams lithium peroxide<br>1000 grams water |
| XIV | 20 grams potassium silicate<br>5 grams sodium peroxide<br>1000 grams water |

-continued

| Example | Composition electrolytic bath |
|---|---|
| XV | 300 grams sodium silicate<br>50 grams sodium peroxide<br>1000 grams water |
| XVI | 500 grams potassium silicate<br>100 grams potassium peroxide<br>1000 grams water |

In the foregoing example, coatings of approximately 0.001 inch were made in about 1 to 5 minutes. These coatings were generally harder and smoother than coatings made in the absence of peroxide, and they also exhibited improved dielectric properties and anti-corrosivity.

Figure 3:
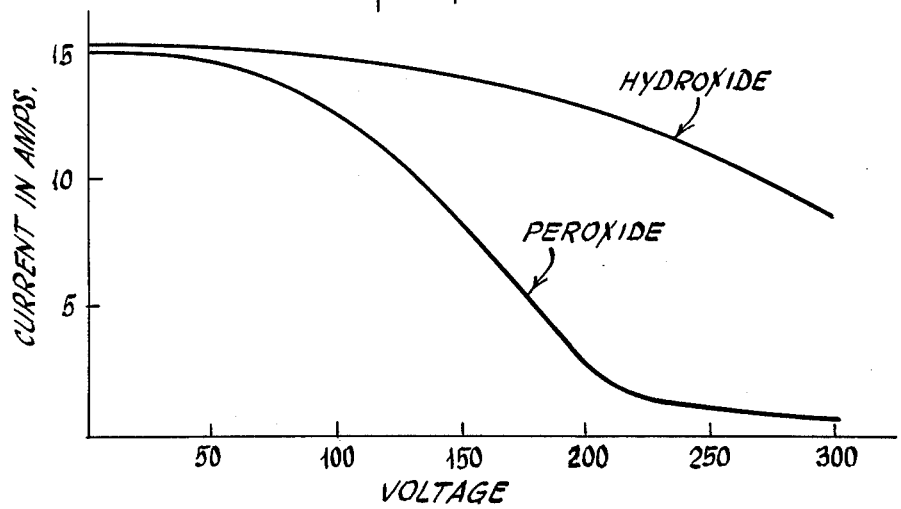
FIG. 3 represents the relationship between the current and the voltage required for coating aluminum in two different electrolytic baths; one containing potassium silicate and sodium peroxide and the other consisting of a mixture of potassium hydroxide and potassium silicate.

When the current required to deposit these coatings is plotted as a function of the voltage potential, the results are shown by the lower curve in FIG. 3. The upper graph in this figure illustrates a similar relationship for coatings obtained using a mixture of potassium silicate and potassium hydroxide as the electrolyte. As shown in FIG. 3, lower voltage is required at the same current to produce the desired coatings when utilizing the method described in Examples, VIII-XVI of this invention.

The metals which are coated with silicates by the method of this invention find widespread utility in fields where anti-corrosity is required. For example, they may be used to fabricate reaction vessels, fluid pipes and other equipment which are employed in handling corrosive fluids.

While the invention has heretofore been described with a certain degree of particularity, it is understood, of course, that several obvious changes and modifications can be made therein which are suggested from the foregoing detailed description and which are nevertheless within the purview and scope of this invention.

What is claimed is:

1. A method of coating a rectifier metal selected from the group consisting of aluminum, tantalium, niobium and alloys thereof, and alloys of aluminum with copper and zinc, to produce a hard, glassy, adherent and corrosion-resistant layer, comprising: (a) immersing said metal in an electrolyte bath consisting essentially of concentrated aqueous solution of potassium silicate, (b) immersing a metal which is cathodic with respect to said rectifier metal in said bath, (c) causing electric current to flow between said rectifier metal and said cathode until a visible spark is discharged at the surface of said rectifier metal, and (d) increasing the voltage potential between said rectifier metal and said cathode to about 300 volts and maintaining said voltage at about 300 volts until the desired layer thickness is deposited on said rectifier metal.

2. A method as in claim 1 wherein said metal cathode is selected from the group consisting of iron and nickel.

3. A method as in claim 2 wherein said metal is aluminum.

4. A method as in claim 3 wherein the concentration of said potassium silicate is from about 5° to about 30° Baume.

5. A method as in claim 2 wherein the concentration of said potassium silicate is from about 5° to about 30° Baume.

6. A method as in claim 1 wherein said metal is aluminum.

7. A method as in claim 6 wherein the concentration of said potassium silicate is from about 5° to about 30° Baume.

8. A method as in claim 1 wherein the concentration of said potassium silicate is from about 5° to about 30° Baume.

9. A method of coating a rectifier metal selected from the group consisting of aluminum, tantalium niobium and alloys thereof, and alloys of aluminum with copper and zinc, to produce a hard, glassy, adherent and corrosion-resistant layer, comprising:

(a) immersing said metal in an electrolyte bath consisting essentially of concentrated aqueous solution of potassium silicate and saturated potassium vanadate, (b) immersing a metal which is cathodic with respect to said rectifier metal in said bath, (c) causing electric current to flow between said rectifier metal and said cathode until a visible spark is discharged at the surface of said rectifier metal, and (d) increasing the voltage potential between said rectifier metal and said cathode to about 300 volts and maintaining said voltage at about 300 volts until the desired layer thickness is deposited on said rectifier metal.

10. A method as in claim 9 wherein said metal cathode is selected from the group consisting of iron and nickel.

11. A method as in claim 10 wherein said metal is aluminum.

12. A method as in claim 11 wherein the concentration of said potassium silicate is from about 5° to about 30° Baume.

13. A method as in claim 10 wherein the concentration of said potassium silicate is from about 5° to about 30° Baume.

14. A method as in claim 9 wherein said metal is aluminum.

15. A method as in claim 14 wherein the concentration of said potassium silicate is from about 5° to about 30° Baume.

16. A method as in claim 9 wherein the concentration of said potassium silicate is from about 5° to about 30° Baume.

17. A method of coating a rectifier metal selected from the group consisting of aluminum, tantalium, niobium and alloys thereof, and alloys of aluminum with copper and zinc, to produce a hard, glassy, adherent and corrosion-resistant layer, comprising:

(a) immersing said metal in a bath made from a mixture of silicate and peroxide, wherein said silicate is selected from the group consisting of concentrated aqueous solution of potassium silicate, lithium silicate and sodium silicate and mixtures thereof, said peroxide is selected from the group consisting of aqueous solution of sodium peroxide, potassium peroxide, lithium peroxide, cesium peroxide and strontium peroxide, and wherein the concentration of said peroxide is from about 1 to about 25 grams per liter, (b) immersing a metal which is cathodic with respect to said rectifier metal in said bath, (c) causing electric current to flow between said rectifier metal and said cathode until a visible spark is discharged at the surface of said rectifier metal, and (d) increasing the voltage potential between said rectifier metal and said cathode to about 300 volts and maintaining said voltage at about 300 volts until the desired layer thickness is deposited on said rectifier metal.

18. A method as in claim 17 wherein said metal cathode is selected from the group consisting of iron and nickel.

19. A method as in claim 18 wherein said metal is aluminum.

20. A method as in claim 19 wherein the concentration of said silicate is from about 5° to about 30° Baume.

21. A method as in claim 18 wherein the concentration of said silicate is from about 5° to about 30° Baume.

22. A method as in claim 17 wherein said silicate is a concentrated aqueous solution of potassium silicate and wherein said peroxide is selected from the group consisting of sodium peroxide, potassium peroxide and lithium peroxide.

23. A method as in claim 22 wherein said metal is aluminum.

24. A method as in claim 23 wherein the concentration of said silicate is from about 5° to about 30° Baume.

25. A method as in claim 22 wherein the concentration of said silicate is from about 5° to about 30° Baume.

26. A method as in claim 17 wherein said metal is aluminum.

27. A method as in claim 26 wherein the concentration of said silicate is from about 5° to about 30° Baume.

28. A method as in claim 17 wherein the concentration of said silicate is from about 5° to about 30° Baume.

* * * * *